US007572312B2

(12) United States Patent
Kawata et al.

(10) Patent No.: US 7,572,312 B2
(45) Date of Patent: Aug. 11, 2009

(54) SINTERED VALVE SEAT AND PRODUCTION METHOD THEREFOR

(75) Inventors: Hideaki Kawata, Matsudo (JP); Hiroki Fujitsuka, Matsudo (JP)

(73) Assignee: Hitachi Powdered Metals Co., Ltd., Matsudo-shi (JP)

( * ) Notice: Subject to any disclaimer, the term of this patent is extended or adjusted under 35 U.S.C. 154(b) by 416 days.

(21) Appl. No.: 11/451,428

(22) Filed: Jun. 13, 2006

(65) Prior Publication Data

US 2006/0278038 A1 Dec. 14, 2006

(30) Foreign Application Priority Data

Jun. 13, 2005 (JP) ..... 2005-172626

(51) Int. Cl.
*B22F 3/12* (2006.01)
*B22F 3/26* (2006.01)

(52) U.S. Cl. ..... 75/231; 75/246; 410/10; 410/27; 410/38

(58) Field of Classification Search ..... 75/231, 75/243, 246; 419/39, 10, 27, 38
See application file for complete search history.

(56) References Cited

U.S. PATENT DOCUMENTS 4,422,875 A 12/1983 Nakata et al.
4,552,590 A 11/1985 Nakata et al.
4,919,719 A 4/1990 Abe et al.
5,949,003 A * 9/1999 Aoki et al. ..... 75/246
6,251,157 B1 * 6/2001 Aoki et al. ..... 75/231
6,562,098 B1 * 5/2003 Fujitsuka et al. ..... 75/243
2005/0132842 A1 6/2005 Kawata et al.

FOREIGN PATENT DOCUMENTS

JP B2 59-37343 9/1984
JP A 2-163351 6/1990
JP B2 5-55593 8/1993
JP B2 7-98985 10/1995

* cited by examiner

*Primary Examiner*—Roy King
*Assistant Examiner*—Ngoclan T Mai
(74) *Attorney, Agent, or Firm*—Oliff & Berridge, PLC

(57) ABSTRACT

A sintered valve seat includes: a matrix; 5 to 40 mass % of a hard phase dispersed in the matrix, the hard phase containing 48 to 60 mass % of Mo; 3 to 12 mass % of Cr; 1 to 5 mass % of Si; and the balance of Co and inevitable impurities; and a structure in which a Cr sulfide is dispersed around the hard phase. The hard phase is formed with a Co base alloy matrix and compounds which are mainly composed of Mo silicides and are integrally precipitated in the Co base alloy matrix.

13 Claims, 2 Drawing Sheets

SINTERED VALVE SEAT AND PRODUCTION METHOD THEREFOR

BACKGROUND OF THE INVENTION

1. Field of the Invention

The present invention relates to a sintered valve seat for automobile engines, and relates to a production method therefor. In particular, the present invention relates to development technique of sintered valve seat which is advantageously used for high load engines, for example, compression natural gas (=CNG) engines and heavy duty diesel engines.

In recent years, operation conditions of automobile engine are very sever due to high performance thereof. Valve seats for engine are required to endure use environments which are severer than those of conventional techniques. For example, in liquefied petroleum gas (=LPG) engine widely used in automobile for taxi, since sliding surfaces of valve and valve seat are used in dry conditions, wear occurs more quickly than that in valve seat for gasoline engine. In environments in which sludge is adhered to valve seat for highly leaded gasoline engine, when surface pressure to valve seat is high or valve seat is used in high temperature and high compression ratio condition, wear is accelerated by the sludge. When valve seat is used in the above severe environments, valve seat is required to have good wear resistance and high strength for prevention of setting.

Valve operating mechanism equipped with a rush adjuster, which can automatically control position of valve and drive timing of valve even when valve seat is worn, has been used. However, engine life problem due to wear of a valve seat is not solved, and development of materials for a valve seat which is superior in wear resistance is desired. In recent years, not only high performance but also development of inexpensive automobile has been important from viewpoint of economic efficiency. Therefore, sintered alloy for a valve seat is required to be highly wear resistant and have high strength without additional mechanism such as the above rush adjuster.

Regarding the above sintered alloy used for valve seat, Japanese Examined Patent Application Publication No. S59-037343 (hereinafter referred to as "Patent Publication 1") proposes a technique in which Co—Mo—Si based hard particle is dispersed into dapped matrix of Fe—Co based matrix and Fe—Cr based matrix. Japanese Examined Patent Application Publication No. H05-055593 (hereinafter referred to as "Patent Publication 2") proposes a technique in which Co—Mo—Si based hard particle is dispersed into Fe—Co based matrix. Japanese Examined Patent Application Publication No. H07-098985 (hereinafter referred to as "Patent Publication 3") proposes a technique in which Co—Mo—Si based hard particle is dispersed into Fe—Co based matrix including Ni. Japanese Unexamined Patent Application Publication No. H02-163351 (hereinafter referred to as "Patent Publication 4") proposes Fe base alloy including Co—Mo—Si base hard particle dispersed thereinto.

Although the hard particle in each alloy disclosed in Patent Publications 1 to 4 includes 40 mass % or less of Mo, the sintered alloy including the above hard particle is very wear-resistant at high temperatures and has high strength. However, in recent years, sintered alloy is desired to be more wear-resistant at high temperatures and has higher strength. In particular, in engine, for example, CNG engine and high-power heavy duty diesel engine, load to valve seat due to metal contact is much higher, so that development of material which is more wear-resistant in the above environments is desired.

SUMMARY OF THE INVENTION

The present invention was made in consideration of the above problems. An object of the present invention is to provide a sintered valve seat which is superior in wear resistance at high temperatures in high load engine environments of, for example, CNG engine and heavy duty diesel engine. An object of the present invention is to provide a production method for the above wear resistant sintered alloy.

According to one aspect of the present invention, a sintered valve seat includes: a matrix; 5 to 40 mass % of hard phase dispersed in the matrix, the hard phase containing 48 to 60 mass % of Mo; 3 to 12 mass % of Cr; 1 to 5 mass % of Si; and the balance of Co and inevitable impurities; and a structure in which Cr sulfides are dispersed around the hard phase. The hard phase is formed with a Co base alloy matrix and compounds which are mainly composed of Mo silicides and are integrally precipitated in the Co base alloy matrix.

According to another aspect of the present invention, a production method for a sintered valve seat includes: preparing a matrix forming steel powder composed of at least one of steel powders (A) to (E), a hard phase forming powder (F), a graphite powder, and a sulfide powder composed of at least one of sulfide powders (G) to (J). The steel powder (A) is a steel powder containing: 1.5 to 5 mass % of Mo; and the balance of Fe and inevitable impurities. The steel powder (B) is a steel powder containing: 2 to 4 mass % of Cr; 0.2 to 0.4 mass % of Mo; 0.2 to 0.4 mass % of V; and the balance of Fe and inevitable impurities. The steel powder (C) is a steel powder containing: 5.5 to 7.5 mass % of Co; 0.5 to 3 mass % of Mo; 0.1 to 3 mass % of Ni; and the balance of Fe and inevitable impurities. The steel powder (D) is a steel powder containing: 0.4 to 4 mass % of Mo; 0.6 to 5 mass % of Ni; 0.5 to 5 mass % of Cu; 0.05 to 2 mass % of Cr; 0.05 to 0.6 mass % of V; and the balance of Fe and inevitable impurities. The steel powder (E) is a partial diffusion steel powder containing: 1 to 10 mass % of Ni; 1 to 3 mass % of Cu; 0.4 to 1.0 mass % of Mo; and the balance of Fe and inevitable impurities. The hard phase forming powder (F) is a Co base alloy powder containing: 48 to 60 mass % of Mo; 3 to 12 mass % of Cr; 1 to 5 mass % of Si; and the balance of Co and inevitable impurities. The sulfide powder (G) is a molybdenum disulfide powder. The sulfide powder (H) is a tungsten disulfide powder. The sulfide powder (I) is an iron sulfide powder. The sulfide powder (J) is a copper sulfide powder. The production method further includes: mixing a raw powder composed of the matrix forming steel powder, 5 to 40 mass % of the hard phase forming powder (F), 0.4 to 1.2 mass % of the graphite powder, and the sulfide powder of which S content in the raw powder is 0.04 to 5 mass %. The production method further includes: compacting the raw powder into a green compact having a desired shape; and sintering the green compact into a sintered compact.

In the aspect of the present invention, since Cr sulfides are precipitated and dispersed around the hard phase formed with a Co base alloy matrix and compounds which are mainly composed of Mo silicides and are integrally precipitated in the Co base alloy matrix, the sintered valve seat is wear resistant in comparison with conventional sintered valve seats. In particular, the sintered valve seat is superior in wear resistance at high temperatures in high-load engine environments.

DETAILED DESCRIPTION FOR THE INVENTION

The present invention provides first to third sintered valve seats by difference of metal structure. These valve seats and production methods therefor will be explained hereinafter.

1. First Sintered Valve Seat

Figure 1:
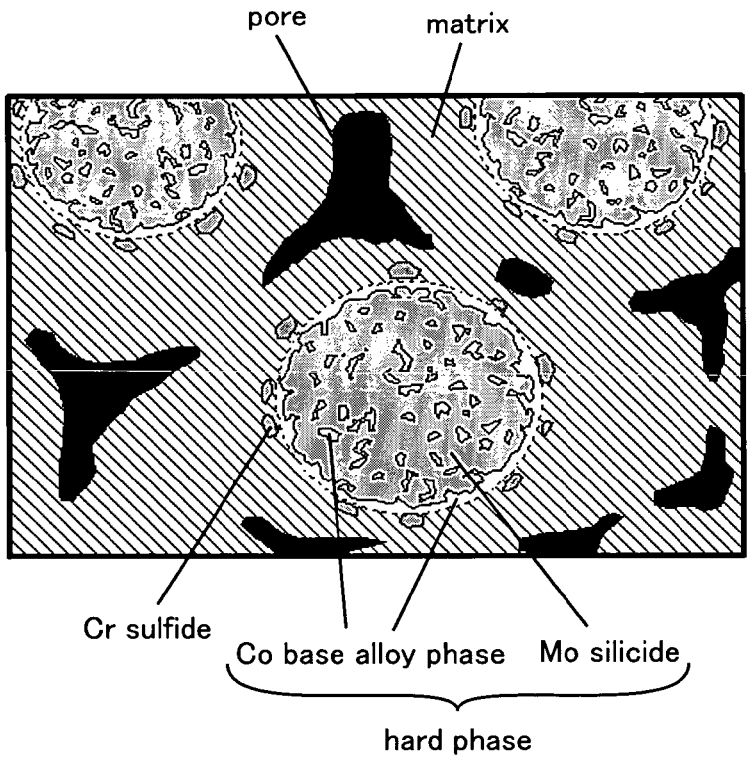
FIG. 1 is a schematic diagram showing a metal structure of a first sintered valve seat according to the present invention.

The first sintered valve seat has a basic structure and includes a matrix; 5 to 40 mass % of hard phase dispersed in the matrix; and a structure in which a Cr sulfide is dispersed around the hard phase. The hard phase includes: 48 to 60 mass % of Mo; 3 to 12 mass % of Cr; 1 to 5 mass % of Si; and the balance of Co and inevitable impurities. The hard phase has a Co base alloy matrix and compounds mainly composed of Mo silicide are integrally precipitated in the Co base alloy matrix. FIG. 1 is a schematic diagram showing a metal structure of first sintered valve seat according to the present invention. Metal structure and included elements of valve seat of the embodiment according to the present invention will be explained hereinafter.

As described above, the hard phase includes: 48 to 60 mass % of Mo; 3 to 12 mass % of Cr; 1 to 5 mass % of Si; and the balance of Co and inevitable impurities. The hard phase has a Co base alloy matrix and compounds which are mainly composed of Mo silicide and are integrally precipitated in the Co base alloy matrix. As shown in FIG. 1, Cr sulfide is precipitated and dispersed around the hard phase.

In the hard phase of the embodiment according to the present invention, precipitated amount of Mo silicide is increased by increase in Mo content, and Mo silicide is integrally precipitated. The Si content is optimized in order to generate required amount of Mo silicide, and increase in powder hardness due to increase in Mo content is inhibited as much as possible.

Figure 4:
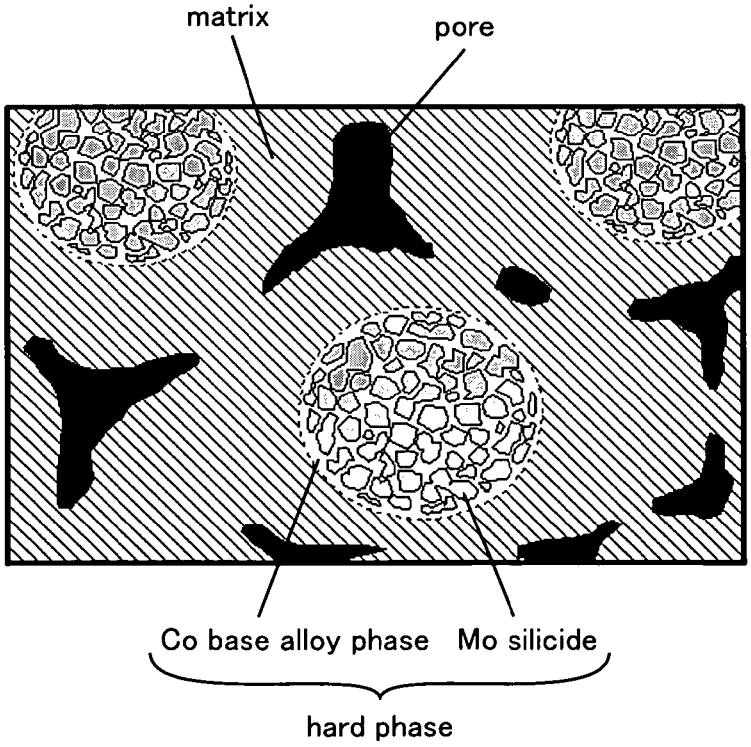
FIG. 4 is a schematic diagram showing a metal structure of a conventional valve seat.

FIG. 4 is a schematic diagram showing a metal structure of conventional valve seat composed of conventional wear resistant sintered alloy. As shown in FIG. 4, in hard phase of the conventional valve seat, Mo silicides are precipitated and gathered in alloy matrix of hard phase. In this metal structure, when metal contact occurs, alloy matrix portion of the hard phase other than the Mo silicide functioning as hard particle initiates plastic flow and adhesion, and wear easily occurs.

In contrast, in the hard phase of the embodiment according to the present invention, Mo silicides are integrally formed, so that generation of plastic flow and adhesion of alloy matrix portion of the hard phase can be inhibited by pinning effect. Therefore, wear resistance can be improved.

In the embodiment according to the present invention, Cr sulfide having good lubricity is precipitated and dispersed around the above hard phase, so that plastic flow of the hard phase is prevented. As a result, wear resistance can be improved greatly.

5 to 40 mass % of the hard phase of the embodiment is dispersed in the matrix of sintered valve seat, so that very good wear resistance of sintered valve seat is obtained. When less than 5 mass % of the hard phase is dispersed in the matrix, improvement effect of wear resistance is small. When more than 5 mass % of the hard phase is dispersed in matrix, since compactability of the mixed powder (raw powder) is deteriorated, strength of sintered compact is lowered and impacts thereof to contacting member is increased. Due to these, wear amount is all the more increased.

The above hard phase can use alloy matrix which has been used as matrix of conventional sintered valve seat and which is produced by matrix forming steel powders (A) to (E) described below. The hard phase is preferably formed by mixing a steel powder or a mixed powder with a hard phase forming powder (F). The hard phase forming powder (F) is a Co base alloy powder containing: 48 to 60 mass % of Mo; 3 to 12 mass % of Cr; 1 to 5 mass % of Si; and the balance of Co and inevitable impurities. The composition of the hard phase forming powder (F) will be explained hereinafter.

Mo is mainly bonded with Si, so that Mo silicide having good wear resistance and lubricity is formed, and wear resistance of sintered alloy is thereby improved. In addition, a portion of Mo silicide forms silicide containing Co, Mo, Cr, and Si. When the Mo content is less than 48 mass %, Mo silicide is not integrally precipitated, and is dispersed in a conventional particle form in Co base hard phase, so that wear resistance is not improved so as to be approximately equal to conventional one. On the other hand, when the Mo content is more than 60 mass %, hardness of the powder is high, and compactability of the powder in compacting is deteriorated. In addition, since formed hard phase is fragile, portion of sintered valve seat is broken, and wear resistance is decreased due to an abrasive powder. Thus, the Mo content in the hard phase is 48 to 60 mass %.

Cr improves strength of Co base matrix of hard phase. Cr is dispersed in Fe matrix, so that hard phase is bonded to the Fe matrix, and Cr is solid-solved in the Fe matrix, so that the Fe matrix is strengthened. Due to these, wear resistance is improved. Cr diffused in the Fe matrix is bonded with S, so that Cr sulfide having good lubricity is formed around the hard phase, and wear resistance is improved. When the Cr content in the hard phase is less than 3 mass %, the above effects are insufficient. On the other hand, when the Cr content in the hard phase is more than 12 mass %, the oxygen amount in powder is large, and oxide coating is formed on surface of the powder, so that sintering of green compact is prevented. In addition, hardness of the powder is high, so that compactability of the powder in compacting is deteriorated. Due to these, strength of sintered alloy is decreased, and wear resistance is decreased, so that the upper limit of the Cr content in the hard phase is 12 mass %. Thus, the Cr content in the hard phase is 3 to 12 mass %.

Si is mainly bonded with Mo, so that Mo silicide having good wear resistance and lubricity is formed, and wear resistance of sintered alloy is thereby improved. When the Si content is less than 1 mass %, Mo silicide is not sufficiently obtained, and wear resistance is not sufficiently improved. On the other hand, when the Si content is excessive, Si which is not reacted with Mo and is diffused in matrix is increased. Si makes Fe matrix hard, but simultaneously makes Fe matrix fragile. Due to these, some degree of diffusion of Si to matrix is effective for adhesion of hard phase to matrix. However, excessive degree of diffusion of Si to matrix causes decrease in wear resistance of Fe matrix and increase in impact of valve seat to contacting member, thereby being unpreferable. In this case, when Si which is not reacted with Mo is reduced, the appropriate Mo content can be supplied without increasing hardness of the powder in accordance with the reduction of Si. Therefore, the upper limit of the Si content in the hard phase is 5 mass % in which Si diffused in matrix without reacting with Mo is started increasing. Thus, the Si content in the hard phase is 1 to 5 mass %.

S for precipitating Cr sulfide formed around hard phase is supplied by decomposing one of sulfide powders (G) to (J). The sulfide powder (G) is a molybdenum disulfide powder, the sulfide powder (H) is a tungsten disulfide powder, the sulfide powder (I) is an iron sulfide powder, and the sulfide powder (J) is a copper sulfide powder.

As described in Reference 1 (Chemical Unabridged Dictionary, 9$^{th}$ Edition, Published by Kyoritsu Shuppan Co., Ltd, Mar. 15, 1964), all sulfides are not chemically stable, and some sulfides are easily decomposed in sintering. Molybdenum disulfide ($MoS_2$), tungsten disulfide ($WS_2$), iron sulfide (FeS), and copper sulfide (CuS) are easily decomposed in a specific condition. It is conceived that, in actual sintering process, the above sulfides are decomposed when decomposition condition is satisfied by water, oxygen, and hydrogen included in an atmosphere, and by water and oxygen which are absorbed to a surface of an iron powder. It is conceived that the sulfide reacts with an activated metal surface at a high temperature, and the activated metal surface functions as a catalyst, so that decomposition of the sulfide may be promoted. It is confirmed that manganese sulfide (MnS) and chrome sulfide (CrS) are difficult to be decomposed as shown in the Reference 1.

The ability of forming sulfide relates to electro-negativity, and S is easily bonded with an element having low electro-negativity and sulfides are formed. The electro-negativity of each element is arranged in a magnitude thereof as follows. Each numeral in round brackets denotes the electro-negativity of the element. Since Mn is the most easily bonded with S, manganese sulfides are preferentially precipitated. The above order corresponds to the description of the Reference 1.

Mn (1.5)<Cr (1.6)<Fe, Ni, Co, Mo (1.8)<Cu (1.9)

In order to precipitate and disperse the sufficient amount of Cr sulfide particle around hard phase by using the above sulfide powders, a sulfide powder is mixed in a raw powder such that the S content mixed in the raw powder should be 0.04 mass % or more. On the other hand, when a sulfide powder is excessively mixed in the raw powder, pores remaining after decomposition of the sulfide powder are increased, and strength of valve seat is thereby lowered, so that wear resistance is decreased. Thus, the upper limit of the S content in the raw powder should be 5 mass %. Metal generated by the decomposition of the sulfide powder is dispersed in the matrix. In this case, when the sulfide powder is selected from the group consisting of a molybdenum disulfide powder, a tungsten disulfide powder, and a copper sulfide powder, Mo, W, and Cu generated by the decomposition of the sulfide powder are dispersed in the matrix, solid solution of the matrix is strengthened by Mo, W, and Cu, and wear resistance of the matrix is improved.

The matrix of valve seat of the embodiment is selected from the group consisting of matrixes (a) to (e).

The matrix (a) is a matrix containing: 1.5 to 5 mass % of Mo; 0.4 to 1.2 mass % of C; and the balance of Fe and inevitable impurities and having a structure composed of bainite. The matrix (b) is a matrix containing: 2 to 4 mass % of Cr; 0.2 to 0.4 mass % of Mo; 0.2 to 0.4 mass % of V; 0.4 to 1.2 mass % of C; and the balance of Fe and inevitable impurities and having a structure composed of bainite. The matrix (c) is a matrix containing: 5.5 to 7.5 mass % of Co; 0.5 to 3 mass % of Mo; 0.1 to 3 mass % of Ni; 0.4 to 1.2 mass % of C; and the balance of Fe and inevitable impurities and having a structure composed of sorbite. The matrix (d) is a matrix containing: 0.4 to 4 mass % of Mo; 0.6 to 5 mass % of Ni; 0.5 to 5 mass % of Cu; 0.05 to 2 mass % of Cr; 0.05 to 0.6 mass % of V: 0.4 to 1.2 mass % of C; and the balance of Fe and inevitable impurities and having one of a structure composed of bainite and a mixed structure of bainite and martensite. The matrix (e) is a matrix containing: 1 to 10 mass % of Ni; 1 to 3 mass % of Cu; 0.4 to 1.0 mass % of Mo; 0.4 to 1.2 mass % of C; and the balance of Fe and inevitable impurities and having a mixed structure of martensite, austenite, bainite and pearlite.

In the embodiment according to the present invention, the matrix can be appropriately selected from the group consisting of the above matrix structures of the matrixes (a) to (e) and mixture thereof in accordance with required wear resistance degree and production cost.

The structures of single phase and mixed phase described in the matrixes (a) to (e) can be formed by using steel powders (A) to (E) and 0.4 to 1.2 mass % of graphite powder as matrix forming powders. The steel powder (A) is a steel powder containing: 1.5 to 5 mass % of Mo; and the balance of Fe and inevitable impurities. The steel powder (B) is a steel powder containing: 2 to 4 mass % of Cr; 0.2 to 0.4 mass % of Mo; 0.2 to 0.4 mass % of V; and the balance of Fe and inevitable impurities. The steel powder (C) is a steel powder containing: 5.5 to 7.5 mass % of Co; 0.5 to 3 mass % of Mo; 0.1 to 3 mass % of Ni; and the balance of Fe and inevitable impurities. The steel powder (D) is a steel powder containing: 0.4 to 4 mass % of Mo, 0.6 to 5 mass % of Ni, 0.5 to 5 mass % of Cu, 0.05 to 2 mass % of Cr, 0.05 to 0.6 mass % of V; and the balance of Fe and inevitable impurities. The steel powder (E) is a partial diffusion steel powder containing: 1 to 10 mass % of Ni; 1 to 3 mass % of Cu; 0.4 to 1.0 mass % of Mo; and the balance of Fe and inevitable impurities.

From view point of compactability of the raw powder, C is supplied by mixing the above steel powder with a graphite powder. When the content of C (the mixed content of the graphite powder) is less than 0.4 mass %, a ferrite structure having low strength and low wear resistance mixed in the matrix. On the other hand, when the content of C (the mixed content of the graphite powder) is more than 1.2 mass %, a cementite which is hard but fragile is precipitated in the matrix, so that impacts thereof to contacting member is increased, and wear resistance and strength are decreased. Therefore, the content of C (the mixed content of the graphite powder) should be 0.4 to 1.2 mass %.

The structure of matrix may have a mixed phase composed of martensite, austenite and bainite by mixing matrix with at least one of 5 mass % or less of Ni powder and 5 mass % or less of Cu powder. In this case, the matrix is strengthened by at least one of 5 mass % or less of Ni powder and 5 mass % or less of Cu powder, so that matrix strength is improved. When Ni powder is mixed and the mixed content of the Ni powder is more than 5 mass %, soft austenite is increased. When the Cu powder is mixed and the mixed content of Cu powder is more than 5 mass %, a soft free copper phase is started generating in the structure of matrix. Due to these, the upper limits of the mixed contents of the Ni powder and the Cu powder should be 5 mass %.

A production method for the first sintered valve seat having the metal structure shown in FIG. 1 is one of the embodiment according to the present invention made based on the above techniques. That is, in the embodiment according to the present invention, a production method for a sintered valve seat includes: preparing a matrix forming steel powder including at least one of steel powders (A) to (E), a hard phase forming powder (F), a graphite powder, and a sulfide powder including at least one of sulfide powders (G) to (J). The production method further includes: mixing a raw powder composed of the matrix forming steel powder, 5 to 40 mass % of the hard phase forming powder (F), 0.4 to 1.2 mass % of the graphite powder, and the sulfide powder of which S content in the raw powder is 0.04 to 5 mass %; compacting the raw powder into a green compact having a desired shape; and sintering the green compact into a sintered compact.

As described above, in the embodiment according to the present invention, the raw powder further includes at least one of 5 mass % or less of Ni powder and 5 mass % or less of Cu powder in order to mix the matrix with at least one of Ni and Cu.

2. Second Sintered Valve Seat

Figure 2:
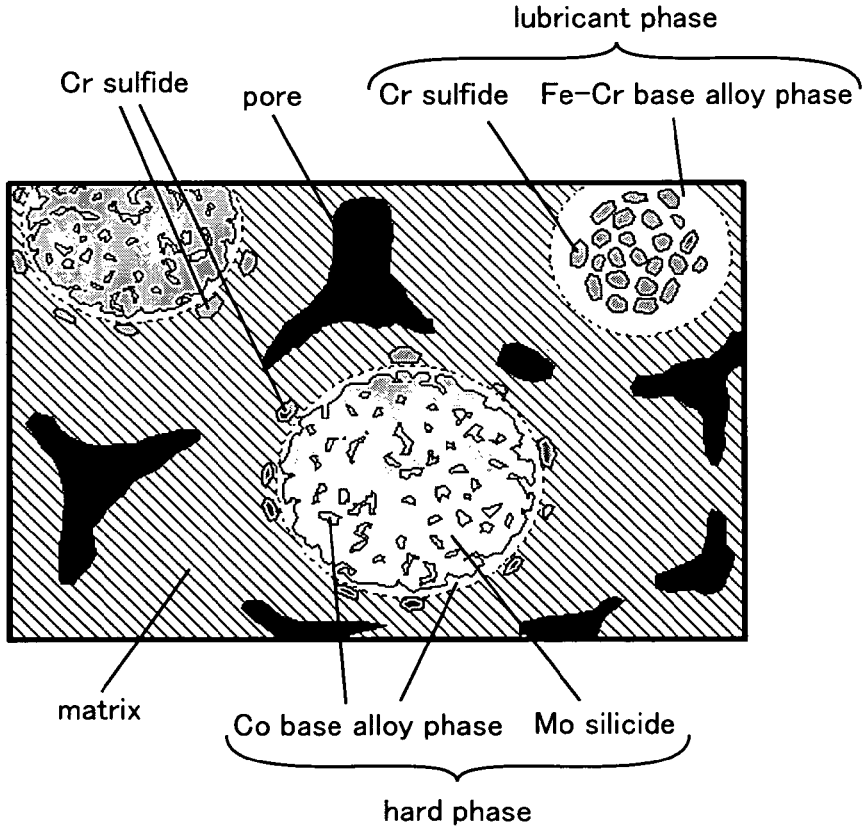
FIG. 2 is a schematic diagram showing a metal structure of a second sintered valve seat according to the present invention.

A second sintered valve seat further includes 5 to 20 mass % of lubricant phase which is dispersed in the matrix of the first sintered valve seat. The lubricant phase has Cr sulfide particles which are precipitated and gathered. FIG. 2 is a schematic diagram showing a metal structure of second sintered valve seat according to the present invention. In the second sintered valve seat, Cr sulfides having good lubricity are mixed around hard phase, and are dispersed and gathered in the matrix in a spotted form, so that lubricity of matrix is improved.

In cutting of valve seat by using a cutting tool, when sulfide is uniformly dispersed in matrix, edge of the cutting tool uniformly contacts the sulfide. Due to this, cutting resistance is reduced, and cut chip is easily removed by chip break action, so that store of heat to the edge is prevented and temperature of the edge is lowered. In the above manner, machinability is improved. On the other hand, since sulfide particles are small, a large amount of sulfide is necessary in order to improve lubricity of matrix structure and wear resistance. However, when a large amount of sulfide is dispersed in the matrix, strength of the matrix is decreased.

Due to this, in the embodiment according to the present invention, Cr sulfides having good lubricity are dispersed and gathered in the matrix in a spotted form, so that wear resistance of matrix is improved by a small amount of Cr sulfide such that strength of matrix is not decreased. When the amount of the lubricant phase dispersed in the matrix is less than 5 mass %, wear resistance improvement by lubricity improvement of matrix is insufficient. On the other hand, when the amount of this lubricant phase dispersed in the matrix is more than 20 mass %, strength of the matrix is greatly decreased. Thus, the amount of the lubricant phase dispersed in the matrix should be 5 to 20 mass %.

The above lubricant phase having Cr sulfide particles precipitated and gathered can be produced by mixing the raw powder with a Cr included steel powder including 4 to 25 mass % of Cr. That is, S is generated by decomposing the above sulfide powder in the sintering process, and is bonded with Cr in the Cr included steel powder, so that Cr sulfide is precipitated at a portion at which the Cr included steel powder initially exists. As a result, the lubricant phase having Cr sulfide particles precipitated and gathered is formed. Therefore, composition of lubricant phase approximately corresponds to that of the initial Cr included steel powder. That is, the lubricant phase includes 4 to 25 mass % of Cr. An alloy matrix which is a portion having Cr sulfide particles precipitated and gathered is a Fe—Cr based alloy matrix.

When the Cr content in the lubricant phase is less than 4 mass %, Cr sulfide is not precipitated, and wear resistance is not improved. On the other hand, when the Cr content in the lubricant phase is more than 25 mass %, the Cr included steel powder becomes hard, compactability thereof is deteriorated, and a phase is generated in the lubricant phase and the lubricant phase is fragile. Thus, the upper limit of the Cr content in the lubricant phase should be 25 mass % or more.

The lubricant phase can be formed by using the Cr included steel powder. The Cr included steel powder is at least of one selected from the group consisting of Cr included steel powders (L) to (Q).

The Cr included steel powder (L) is a Cr included steel powder containing: 4 to 25 mass % of Cr; and the balance of Fe and inevitable impurities. The Cr included steel powder (M) is a Cr included steel powder containing: 4 to 25 mass % of Cr; 3.5 to 22 mass % of Ni; and the balance of Fe and inevitable impurities. The Cr included steel powder (N) is a Cr included steel powder containing: 4 to 25 mass % of Cr; at least one selected from the group consisting of 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se; and the balance of Fe and inevitable impurities. The Cr included steel powder (0) is a Cr included steel powder containing: 4 to 25 mass % of Cr; 3.5 to 22 mass % of Ni; at least one selected from the group consisting of 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se; and the balance of Fe and inevitable impurities. The Cr included steel powder (P) is a Cr included steel powder containing: 7.5 to 25 mass % of Cr; 0.3 to 3 mass % of Mo; 0.25 to 2.4 mass % of C; at least one of 0.2 to 2.2 mass % of V and 1.0 to 5.0 mass % of W; and the balance of Fe and inevitable impurities. The Cr included steel powder (Q) is a Cr included steel powder containing: 4 to 6 mass % of Cr; 4 to 8 mass % of Mo; 0.5 to 3 mass % of V; 4 to 8 mass % of W; 0.6 to 1.2 mass % of C; and the balance of Fe and inevitable impurities.

The above steel powder (L) is composed of Fe—Cr alloy and is known as a ferrite stainless steel powder including more than 12 mass % of Cr. A ferrite based stainless steel powder of which characteristic is improved by another element such as the above steel powder (N) can be used.

The above steel powder (M) is composed of Fe—Ni—Cr alloy and is known as an austenite stainless steel powder including more than 12 mass % of Cr. An austenite stainless steel powder of which characteristic is improved by another element such as the above steel powder (O) can be used.

The above steel powder (P) is a powder of alloy tool steel for cold working mold or hot forming mold, in which included Cr is originally precipitated as Cr carbide but large portion of included Cr is precipitated as Cr sulfide when Cr exists with S in the embodiment according to the present invention. Cr carbide is remained at a portion of the Cr sulfide. Carbide selected from the group consisting of Mo carbide, V carbide, W carbide, and mixture thereof are precipitated, and lubricant phase in which carbide exists with Cr sulfide is obtained.

The above steel powder (Q) is known as a high speed steel powder. In the same manner as the above steel powder (P), Cr exists with S and is precipitated as Cr sulfide, and Cr carbide is remained at a portion of the Cr sulfide. Carbide selected from the group consisting of Mo carbide, V carbide, W carbide, and mixture thereof are precipitated, and lubricant phase in which carbide exists with Cr sulfide is obtained.

A production for the second sintered valve seat having the metal structure shown in FIG. 2 is one of the embodiment according to the present invention made based on the above techniques. That is, in the production method for first sintered valve seat, the raw powder further includes 5 to 20 mass % of a Cr included steel powder as a lubricant phase forming powder, the Cr included steel powder including 4 to 25 mass % of Cr. In this case, the Cr included steel powder is at least one selected from the group consisting of the above steel powders (L) to (Q).

3. Third Sintered Valve Seat

Figure 3:
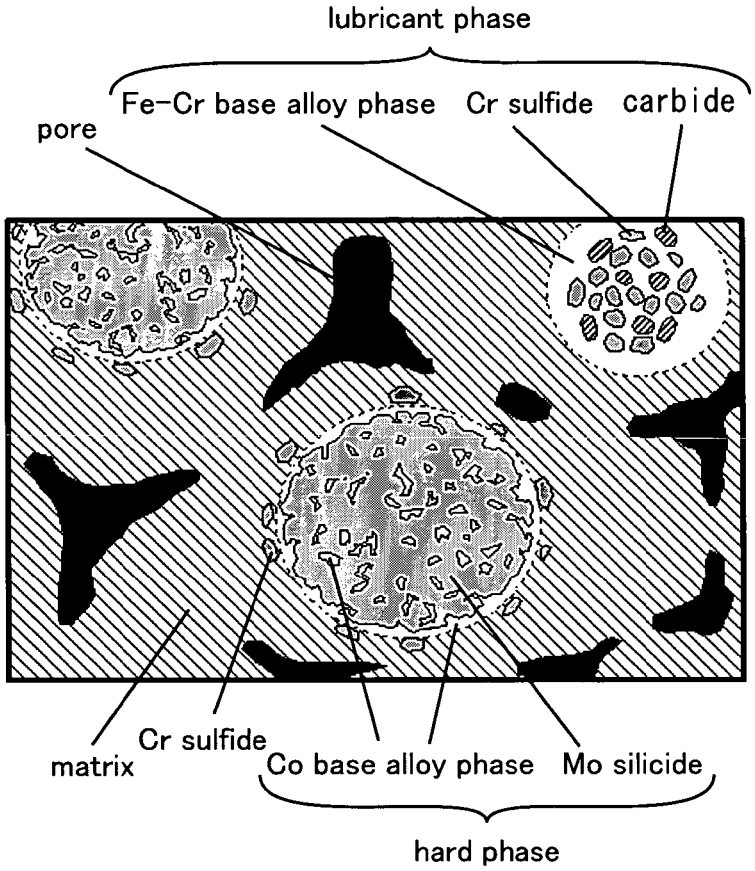
FIG. 3 is a schematic diagram showing a metal structure of a third sintered valve seat according to the present invention.

When the above steel powders (P) and (Q) are used, a structure having carbides precipitated with Cr sulfide in the lubricant phase is formed. A third sintered valve seat has this structure. FIG. 3 is a schematic diagram showing a metal structure of a third sintered valve seat according to the present invention. In the third sintered valve seat, plastic flow of alloy matrix portion of the lubricant phase is prevented, and wear resistance can be greatly improved. In comparison of the case using the steel powder (P) and the case using the steel powder (Q), in the case using the steel powder (P), the amount of carbides is smaller than in the case using the steel powder (Q). And in the case using the steel powder (Q), lubricant phase having a large amount of precipitated carbides is obtained. The steel powders (P) and (Q) can be selectively used in accordance with desired characteristic of the lubricant phase.

In the above first to third sintered valve seats of the embodiment according to the present invention, conventional techniques of adding materials for improving machinability can be used. For example, at least one selected from the group consisting of manganese sulfide particles, calcium fluoride particles, boron nitride particles, magnesium silicate mineral particles, bismuth particles, and bismuth oxide particles is dispersed in pores and powder boundaries of the above wear resistant sintered member.

The above materials for improving machinability are chemically stable at high temperatures. Even if the powders of above materials for improving machinability are added to a raw material powder, the above materials are not decomposed in sintering and are dispersed in the above portion, so that the machinability of the wear resistant sintered member can be improved. By using the above techniques of adding materials for improving machinability, the machinability of the wear resistant sintered member can be improved greatly. When the above techniques of adding materials for improving machinability is used, the upper limit of amount of the above material for improving machinability should be 2.0 mass % in the wear resistant sintered member since the strength of the wear resistant sintered member is decreased and wear resistance thereof is decreased when the above material for improving machinability is excessively added.

In the wear resistant sintered valve seat of the embodiment according to the present invention, as disclosed in Patent Publication 2, at least one selected from the group consisting of lead or lead alloy, copper or copper alloy, and aclylic resin can be filled in the pores of the wear resistant sintered member by impregnating or infiltrating, so that the machinability can be improved.

That is, when lead or lead alloy, copper or copper alloy, or aclylic resin exists in the pores, cutting is changed from intermittently cutting to sequential cutting in machining the wear resistant sintered member, and impact given to a cutting tool used in the machining is reduced, so that the damage to the edge of the cutting tool is prevented, and the machinability of the sintered member is improved. Since lead, lead alloy, copper and copper alloy are soft, these materials are adhered to the edge of the cutting tool, so that the edge of the cutting tool is protected, the machinability is improved, and the service life of the cutting tool is prolonged. Furthermore, in using the cutting tool, the above materials functions as a solid lubricant between a valve seat and a face surface of a valve, so that the wear of them can be reduced. Since copper and copper alloy has high thermal conductivity, heat generated in the edge of the cutting tool is dissipated to outside, store of heat in the edge portion of the cutting tool is prevented, and damage to the edge portion is reduced.

In the embodiment of the present invention, the sintered valve seat includes: a matrix; 5 to 40 mass % of a hard phase dispersed in the matrix, the hard phase containing 48 to 60 mass % of Mo; 3 to 12 mass % of Cr; 1 to 5 mass % of Si; and the balance of Co and inevitable impurities; and a structure in which Cr sulfides are dispersed around the hard phase, wherein the hard phase is formed with a Co base alloy matrix and compounds which are mainly composed of Mo silicides and are integrally precipitated in the Co base alloy matrix. In the sintered valve seat, a load due to metal contact is reduced, and the sintered valve seat is very superior in wear resistance at high temperatures in high-load engine environments of, for example, CNG engine and heavy duty diesel engine.

EMBODIMENTS

Embodiment 1

Various powders having compositions described below were mixed with each other, and were mixed with a forming lubricant including 0.8 mass % of zinc stearate, so that raw powders were prepared. It should be noted that numeral before chemical symbol for element denotes mass % of element included in powder. For example, "Fe-5Mo" denotes that 5 mass % of Mo is included and the balance is composed of Fe and inevitable impurities.

A matrix forming powder was composed of Fe-5Mo (which was the balance of the raw powder). A hard phase forming powder had a composition shown in Table 1, and 25 mass % of the hard phase forming powder was constantly included in the raw powder. A sulfide powder was composed of $MoS_2$, and 2 mass % of the sulfide powder was included in the raw powder. 1.1 mass % of a graphite powder was included in the raw powder.

The raw powders were compacted into green compacts at a compacting pressure of 650 MPa. The green compacts had a ring shape having an outer of 30 mm, an inner diameter of 20 mm, and a height of 10 mm.

TABLE 1

| Sample | Hard Phase Forming Powder mass % | | | | Wear Amount μm | | | |
|---|---|---|---|---|---|---|---|---|
| | | | | | Valve | | Total | |
| No. | Co | Mo | Cr | Si | Seat | Valve | Amount | Note |
| 01 | Balance | 45.0 | 10.0 | 3.0 | 130 | 23 | 153 | Out of range of present invention |
| 02 | Balance | 48.0 | 10.0 | 3.0 | 92 | 6 | 98 | |
| 03 | Balance | 50.0 | 10.0 | 3.0 | 73 | 3 | 76 | |

TABLE 1-continued

| Sample | Hard Phase Forming Powder mass % | | | | Wear Amount μm | | | |
|---|---|---|---|---|---|---|---|---|
| | | | | | Valve | | Total | |
| No. | Co | Mo | Cr | Si | Seat | Valve | Amount | Note |
| 04 | Balance | 55.0 | 10.0 | 3.0 | 68 | 4 | 72 | |
| 05 | Balance | 60.0 | 10.0 | 3.0 | 70 | 8 | 78 | |
| 06 | Balance | 65.0 | 10.0 | 3.0 | 150 | 35 | 185 | Out of range of present invention |
| 07 | Balance | 50.0 | 0.0 | 3.0 | 170 | 0 | 170 | Out of range of present invention |
| 08 | Balance | 50.0 | 3.0 | 3.0 | 105 | 1 | 106 | |
| 09 | Balance | 50.0 | 5.0 | 3.0 | 80 | 3 | 83 | |
| 10 | Balance | 50.0 | 12.0 | 3.0 | 85 | 5 | 90 | |
| 11 | Balance | 50.0 | 15.0 | 3.0 | 150 | 12 | 162 | Out of range of present invention |
| 12 | Balance | 50.0 | 10.0 | 0.0 | 240 | 0 | 240 | Out of range of present invention |
| 13 | Balance | 50.0 | 10.0 | 1.0 | 90 | 3 | 93 | |
| 14 | Balance | 50.0 | 10.0 | 5.0 | 70 | 5 | 75 | |
| 15 | Balance | 50.0 | 10.0 | 7.0 | 180 | 8 | 188 | Out of range of present invention |
| 16 | Balance | 28.0 | 8.0 | 2.5 | 190 | 50 | 240 | Conventional Example |

Next, the green compacts were sintered at 1180° C. for 60 minutes in a decomposed ammonia gas atmosphere, and the samples 01 to 16 having compositions shown in Table 1 were produced. Simplified wear tests were performed on the samples in the below manner.

The simplified wear tests were performed in the loaded state of striking and sliding at a high temperature. More specifically, the above sample was processed into a valve seat shape having a slope of 45 degrees at the inner side, and the sample was press-fitted into a housing made of an aluminum alloy. A disc-shaped contacting member (valve) with the valve seat was made from SUH-36, and an outer surface thereof partially had a slope of 45 degrees. The valve was driven by motor, and vertical piston motions were caused by rotation of an eccentric cam, and sloped sides of the sample and contacting member were repeatedly contacted.

That is, valve motions were repeated actions of releasing motion of departing from the valve seat by the eccentric cam rotated by motor driving, and contacting motion on the valve seat by the valve spring, and vertical piston motions were performed. In this test, the contacting member was heated by a burner and the temperature of the sample was set to a temperature of 300° C., and strike operations in the simplified wear test were 2800 times/minute, and the duration was 15 hours. In this manner, wear amount of the samples and the contacting members after the tests (which are noted as the valve seats and the valves after the tests in Table 1) were measured and evaluated. The test results are shown in Table 1.

As shown in samples 01 to 06 in Table 1, in the samples 02 to 05 of which the hard phase forming powder included 48 to 60 mass % of Mo, wear amount of the valve seats and the valves were stably low, and the samples 02 to 05 had good wear resistance. On the other hand, in the samples 01 and 06 of which the hard phase forming powder did not include 48 to 60 mass % of Mo, in particular, wear amount of the valve seats was very high, and wear amount of the valves was relatively high. Thus, it was confirmed that good wear resistance can be obtained when the hard phase forming powder includes 48 to 60 mass % of Mo.

As shown in the samples 03 and 07 to 11 in Table 1, in the samples 03 and 08 to 10 of which the hard phase forming powder included 3 to 12 mass % of Cr, wear amount of the valve seats and the valves were stably low, and it was confirmed that the samples 03 and 08 to 10 had good wear resistance. On the other hand, in the samples 07 and 11 of which the hard phase forming powder did not include 3 to 12 mass % of Cr, in particular, wear amount of the valve seats was very high. Thus, it was confirmed that good wear resistance can be obtained when the hard phase forming powder includes 3 to 12 mass % of Cr.

As shown in samples 03 and 12 to 16, in the samples 03, 13 and 14 of which the hard phase forming powder included 1 to 5 mass % of Si, wear amount of the valve seats and the valves were stably low, and it was confirmed that samples 03, 13 and 14 had good wear resistance. On the other hand, in the samples 12 and 15 of which the hard phase forming powder did not include 1 to 5 mass % of Si, in particular, wear amount of the valve seats was very high. Thus, it was confirmed that good wear resistance can be obtained when the hard phase forming powder includes 1 to 5 mass % of Si.

It was confirmed that the samples within the range of the present invention have wear resistance much better than the conventional example (sample 16). In observation of metal structure of the sample 03, as shown in FIG. 1, it was confirmed that chromium sulfide was dispersed around the hard phase.

Embodiment 2

In the same manner as in Embodiment 1, various powders described below were mixed into raw powders, the raw powders were compacted into green compacts, and the green compacts were sintered, so that ring-shaped samples were produced. Simplified wear tests were performed on the samples in the same conditions as in Embodiment 1. The test results are shown in Table 2.

A matrix forming powder was composed of Fe-5Mo (which was the balance of the raw powder). A hard phase forming powder composed of Co-50Mo-10Cr-3Si, and mixed ratio of the hard phase forming powder is shown in Table 2. A sulfide powder was composed of $MoS_2$, and 2 mass % of the sulfide powder was included in the raw powder. 1.1 mass % of graphite powder was included in the raw powder.

TABLE 2

| Sample No. | Mixed Amount of Hard Phase: Forming Alloy Powder mass % | Wear Amount μm: Valve Seat | Valve | Total Amount | Note |
|---|---|---|---|---|---|
| 17 | 0 | 400 | 0 | 400 | Out of range of present invention |
| 18 | 5 | 140 | 1 | 141 | |
| 19 | 15 | 95 | 2 | 97 | |
| 20 | 20 | 80 | 3 | 83 | |
| 03 | 25 | 73 | 3 | 76 | |
| 21 | 30 | 75 | 5 | 80 | |
| 22 | 40 | 95 | 15 | 110 | |
| 23 | 50 | 140 | 48 | 188 | Out of range of present invention |
| 16 | 25 | 190 | 50 | 240 | Conventional Example |

As shown in Table 2, in the samples 03, and 18 to 22 of which mixed ratio of the hard phase forming alloy powder to the raw powder was 5 to 40 mass %, wear amount of the valve seats and the valves were stably low, and it was confirmed that samples 03, and 18 to 22 had good wear resistance. On the other hand, in the samples 13 and 23 of which mixed ratio of the hard phase forming alloy powder to the raw powder was not 5 to 40 mass %, in particular, wear amount of the valve seats was very high. Thus, it was confirmed that good wear resistance can be obtained when mixed ratio of the hard phase forming alloy powder to the raw powder is 5 to 40 mass %.

Embodiment 3

In the same manner as in Embodiment 1, various powders described below were mixed into raw powders, the raw powders were compacted into green compacts, and the green compacts were sintered, so that ring-shaped samples were produced. Simplified wear tests were performed on the samples in the same conditions as in Embodiment 1. The test results are shown in Table 3.

A matrix forming powder was Fe-5Mo steel powder (which was the balance of the raw powder). A matrix forming powder was a Fe-6.5Co-1.5Mo-1.5Ni steel powder (which was the balance of the raw powder). A matrix forming powder was Fe-3Cr-0.3Mo-0.3V steel powder (which was the balance of the raw powder). A matrix forming powder was a mixed steel powder composed of Fe-6.5Co-1.5Mo-1.5Ni and Fe-3Cr-0.3Mo-0.3V at a mixed ratio of 1:1 (which was the balance of the raw powder). A matrix forming powder was a Fe-4Ni-1.5Cu-0.5Mo partial diffusion steel powder (which was the balance of the raw powder). 25 mass % of hard phase forming powder composed of Co-50Mo-10Cr-3Si was included in raw powder. In conventional example, 25 mass % of hard phase forming powder composed of Co-28Mo-8Cr-2.5Si was included in raw powder. A sulfide powder was composed of $MoS_2$, and 2 mass % of the sulfide powder was included in raw powder. 1.1 mass % of graphite powder was included in raw powder.

TABLE 3

| Sample No. | Raw Powder: Matrix Forming Powder | Hard Phase Forming Powder | Sulfide Powder | Wear Amount μm: Valve Seat | Valve | Total Amount | Note |
|---|---|---|---|---|---|---|---|
| 03 | Fe—5Mo | Co—50Mo—10Cr—3Si | Mixed | 73 | 3 | 76 | |
| 16 | | Co—28Mo—8Cr—2.5Si | None | 190 | 50 | 240 | Conventional Example |
| 24 | Fe—6.5Co—1.5Mo—1.5Ni | Co—50Mo—10Cr—3Si | Mixed | 80 | 3 | 83 | |
| 25 | | Co—28Mo—8Cr—2.5Si | None | 210 | 45 | 255 | Conventional Example |
| 26 | Fe—3Cr—0.3Mo—0.3V | Co—50Mo—10Cr—3Si | Mixed | 95 | 3 | 98 | |
| 27 | | Co—28Mo—8Cr—2.5Si | None | 240 | 40 | 280 | Conventional Example |
| 28 | Fe—6.5Co—1.5Mo—1.5Ni + | Co—50Mo—10Cr—3Si | Mixed | 75 | 3 | 78 | |
| 29 | Fe—3Cr—0.3Mo—0.3V | Co—28Mo—8Cr—2.5Si | None | 200 | 45 | 245 | Conventional Example |
| 30 | Fe—4Ni—1.5Cu—0.5Mo | Co—50Mo—10Cr—3Si | Mixed | 90 | 3 | 93 | |
| 31 | | Co—28Mo—8Cr—2.5Si | None | 220 | 40 | 260 | Conventional Example |

Embodiment 3 had the samples in which hard phase of the present invention and sulfide were used with various matrixes and samples in which hard phase of conventional technique was used with various matrixes. In the Embodiment 3, wear resistances of the samples using hard phase of the present invention and using hard phase of the conventional technique were compared. As shown in Table 3, it was confirmed that the samples using hard phase of the present invention with various matrixes for conventional valve seat had wear resistance much better than the samples using hard phase of the conventional technique with various matrixes for conventional valve seat. In addition, it was confirmed that hard phase of the present invention can be used with matrixes for conventional valve seat.

Embodiment 4

In the same manner as in Embodiment 1, various powders described below were mixed into raw powders, the raw powders were compacted into green compacts, and the green compacts were sintered, so that ring-shaped samples were produced. Simplified wear tests were performed on the samples in the same conditions as in Embodiment 1. The test results are shown in Table 4.

A matrix forming powder was composed of Fe-5Mo (which was the balance of the raw powder). 25 mass % of hard phase forming powder composed of Co-50Mo-10Cr-3Si was included in raw powder. Various sulfide powders were used as shown in Table 4, and 2 mass % of the sulfide powder was included in raw powder. 1.1 mass % of graphite powder was included in raw powder.

TABLE 4

| Sample No. | Type of Sulfide Powder | Wear Amount μm Valve Seat | Valve | Total Amount | Note |
|---|---|---|---|---|---|
| 03 | $MoS_2$ | 73 | 3 | 76 | Dispersed CrS |
| 32 | $WS_2$ | 75 | 3 | 78 | Dispersed CrS |
| 33 | FeS | 80 | 5 | 85 | Dispersed CrS |
| 34 | CuS | 78 | 25 | 103 | Dispersed CrS |
| 35 | MnS | 140 | 50 | 190 | Without Dispersed CrS |
| 16 | — | 190 | 46 | 236 | |

Metal structure observation was performed on the samples 32 to 35 shown in Table 4, and existence of chromium sulfide in the samples was examined. In the samples 32 to 34 including tungsten disulfide, iron sulfide, and copper sulfide which are easily to decompose, particles of chromium sulfide were precipitated around hard phase in the same manner as in the sample 03 including molybdenum disulfide. On the other hand, in the sample 35 including manganese sulfide which is stable sulfide, sulfide was dispersed in pores and between power particle boundaries as manganese sulfide, and precipitated sulfide did not exist in matrix around hard phase. Thus, it was confirmed that sulfide which is easily to decompose is included in raw powder, S (sulfur) is thereby generated by decomposition of sulfide in sintering, and S is precipitated as chromium sulfide formed by bonding of S with Cr diffused from hard phase to matrix. As shown in Table 4, in the samples 03 and 32 to 34 including chromium sulfide precipitated around hard phase, wear resistance was improved, and it was confirmed that the samples 03 and 32 to 134 had good wear resistance.

Embodiment 5

In the same manner as in Embodiment 1, various powders described below were mixed into raw powders, the raw powders were compacted into green compacts, and the green compacts were sintered, so that ring-shaped samples were produced. Simplified wear tests were performed on the samples in the same conditions as in Embodiment 1. The test results are shown in Table 5.

A matrix forming powder was composed of Fe-5Mo (which was the balance of the raw powder). 25 mass % of hard phase forming powder composed of Co-50Mo-10Cr-3Si was included in raw powder. A sulfide powder was composed of $MoS_2$, and 2 mass % of the sulfide powder was included in raw powder. 1.1 mass % of graphite powder was included in raw powder. Lubricant phase forming powder was composed of Fe-12Cr-1Mo-0.5V-1.4C, and mixed ratio of the lubricant phase forming powder is shown in Table 5.

TABLE 5

| Sample No. | Mixed Amount of Lubricant Phase Forming Powder mass % | Wear Amount μm Valve Seat | Valve | Total Amount | Note |
|---|---|---|---|---|---|
| 03 | 0 | 73 | 3 | 76 | |
| 36 | 5 | 65 | 3 | 68 | |
| 37 | 10 | 60 | 2 | 62 | |
| 38 | 15 | 63 | 2 | 65 | |
| 39 | 20 | 68 | 3 | 71 | |
| 40 | 25 | 125 | 5 | 130 | Out of range of present invention |

As shown in Table 5, it was confirmed that wear amount was small and wear resistance was improved in the sample 36 in which 0.5 mass % of lubricant phase forming powder was included in raw powder in comparison with the sample 03 in which lubricant phase forming powder was not included. In the sample 37 in which 10 mass % of lubricant phase forming powder was included in raw powder, the improvement effect of wear resistance was the largest. On the other hand, when more than 10 mass % of lubricant phase forming powder was included in raw powder, the improvement effect of wear resistance became small. When more than 10 mass % of lubricant phase forming powder was included in raw powder, the improvement effect of wear resistance became small. When more than 20 mass % of lubricant phase forming powder was included in raw powder, the influence of strength decrease of matrix became large, so that wear amount was increased. Thus, it was confirmed that the improvement effect of wear resistance is large when 5 to 20 mass % of lubricant phase forming powder is included in raw powder.

Metal structure observation was performed on the sample 37 in which lubricant phase forming powder was included in raw powder. It was confirmed that chromium sulfide was precipitated around hard phase, and particles of chromium sulfide were precipitated in a group condition at portion at which lubricant phase forming powder initially existed. It was confirmed that carbide particles were precipitated at a portion of lubricant phase in which particles of chromium sulfide were precipitated in a group condition.

Embodiment 6

In the same manner as in Embodiment 1, various powders described below were mixed into raw powders, the raw powders were compacted into green compacts, and the green compacts were sintered, so that ring-shaped samples were produced. Simplified wear tests were performed on the samples in the same conditions as in Embodiment 1. The test results are shown in Table 6.

A matrix forming powder was composed of Fe-5Mo (which was the balance of the raw powder). 25 mass % of hard phase forming powder composed of Co-50Mo-10Cr-3Si was included in raw powder. A sulfide powder was composed of $MoS_2$, and 2 mass % of the sulfide powder was included in raw powder. 1.1 mass % of graphite powder was included in raw powder. Various lubricant phase forming powders were used as shown in Table 6. 10 mass % of lubricant phase forming powder was included in raw powder.

TABLE 6

| Sample No. | Type of Lubricant Phase Forming Powder | Wear Amount μm Valve Seat | Valve | Total Amount | Note |
|---|---|---|---|---|---|
| 37 | Fe—12Cr—1Mo—0.5V—1.4C | 60 | 2 | 62 | |
| 41 | Fe—12Cr | 65 | 1 | 66 | |
| 42 | Fe—18Cr—8Ni | 60 | 3 | 63 | |
| 43 | Fe—4Cr—5Mo—2V—6W—1C | 55 | 10 | 65 | |
| 03 | — | 73 | 3 | 76 | |

As shown in Table 6, it was confirmed that improvement effect of wear resistance was obtained even when various lubricant phase forming powders were used. Metal structure observation was performed on the samples. It was confirmed that in the samples 41 and 42, chromium sulfide were precipitated around hard phase, and lubricant phase in which chromium sulfide particles were precipitated in a group condition was dispersed in matrix. It was confirmed that in the sample 43, chromium sulfide was precipitated around hard phase, and lubricant phase in which chromium sulfide particles and carbide particles were precipitated in a group condition was dispersed in matrix.

What is claimed is:

1. A sintered valve seat comprising:

a matrix;

5 to 40 mass % of hard phase dispersed in the matrix, the hard phase containing: 48 to 60 mass % of Mo; 3 to 12 mass % of Cr; 1 to 5 mass % of Si; and the balance of Co and inevitable impurities; and a structure in which Cr sulfides are dispersed around the hard phase, wherein the hard phase is formed with a Co base alloy matrix and compounds which are mainly composed of Mo silicides and are integrally precipitated in the Co base alloy matrix.

2. A sintered valve seat according to claim 1, wherein the sintered valve seat contains 0.04 to 5 mass % of S.

3. A sintered valve seat according to claim 1, wherein the sintered valve seat further comprises:

5 to 20 mass % of lubricant phase dispersed in the matrix and containing 4 to 25 mass % of Cr, wherein the lubricant phase is formed such that Cr sulfide particles are precipitated and gathered in a Fe—Cr based alloy matrix.

4. A sintered valve seat according to 3, wherein the sintered valve seat further includes carbides dispersed in the lubricant phase.

5. A sintered valve seat according to claim 1, wherein the sintered valve seat has pores, powder boundaries, and a metal structure which is formed in the pores and between the powder boundaries and in which 2 mass % or less of at least one selected from the group consisting of manganese sulfide particles, calcium fluoride particles, boron nitride particles, magnesium silicate mineral particles, bismuth particles, and bismuth oxide particles is dispersed.

6. A sintered valve seat according to claim 1, wherein the sintered valve seat has pores, and one selected from the group consisting of lead, lead alloy, copper, copper alloy, and aclylic resin is filled in the pores.

7. A production method for a sintered valve seat, comprising:

preparing a matrix forming steel powder composed of at least one of steel powders (B) to (E), a hard phase forming powder (F), a graphite powder, and a sulfide powder composed of at least one of sulfide powders (G) to (J);

mixing a raw powder composed of the matrix forming steel powder, 5 to 40 mass % of the hard phase forming powder (F), 0.4 to 1.2 mass % of the graphite powder, and the sulfide powder of which S content in the raw powder is 0.04 to 5 mass %;

compacting the raw powder into a green compact having a desired shape; and sintering the green compact into a sintered compact, wherein the steel powder (B) is a steel powder containing: 2 to 4 mass % of Cr; 0.2 to 0.4 mass % of Mo; 0.2 to 0.4 mass % of V; and the balance of Fe and inevitable impurities, the steel powder (C) is a steel powder containing: 5.5 to 7.5 mass % of Co; 0.5 to 3 mass % of Mo; 0.1 to 3 mass % of Ni; and the balance of Fe and inevitable impurities, the steel powder (D) is a steel powder containing: 0.4 to 4 mass % of Mo; 0.6 to 5 mass % of Ni; 0.5 to 5 mass % of Cu; 0.05 to 2 mass % of Cr; 0.05 to 0.6 mass % of V; and the balance of Fe and inevitable impurities, and the steel powder (E) is a partial diffusion steel powder containing: 1 to 10 mass % of Ni; 1 to 3 mass % of Cu; 0.4 to 1.0 mass % of Mo; and the balance of Fe and inevitable impurities, the hard phase forming powder (F) is a Co base alloy powder containing: 48 to 60 mass % of Mo; 3 to 12 mass % of Cr; 1 to 5 mass % of Si; and the balance of Co and inevitable impurities, and the sulfide powder (G) is a molybdenum disulfide powder, the sulfide powder (H) is a tungsten disulfide powder, the sulfide powder (I) is an iron sulfide powder, and the sulfide powder (J) is a copper sulfide powder.

8. A production method for a sintered valve seat according to claim 7, wherein the raw powder further includes 5 mass % or less of Ni powder.

9. A production method for a sintered valve seat according to claim 7, wherein the raw powder further contains 5 mass % or less of Cu powder.

10. A production method for a sintered valve seat according to claim 7, wherein the raw powder further contains 5 to 20 mass % of Cr included steel powder as a lubricant phase forming powder, the Cr included steel powder containing 4 to 25 mass % of Cr.

11. A production method for a sintered valve seat according to claim 10, wherein the Cr included steel powder is composed of at least one selected from the group consisting of Cr included steel powders (L) to (Q), wherein the Cr included steel powder (L) is a Cr included steel powder containing: 4 to 25 mass % of Cr; and the balance of Fe and inevitable impurities, the Cr included steel powder (M) is a Cr included steel powder containing: 4 to 25 mass % of Cr; 3.5 to 22 mass % of Ni ;and the balance of Fe and inevitable impurities, the Cr included steel powder (N) is a Cr included steel powder containing: 4 to 25 mass % of Cr; at least one selected from the group consisting of 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se; and the balance of Fe and inevitable impurities, the Cr included steel powder (O) is a Cr included steel powder containing: 4 to 25 mass % of Cr; 3.5 to 22 mass % of Ni; at least one selected from the group consisting of 0.3 to 7 mass % of Mo, 1 to 4 mass % of Cu, 0.1 to 5 mass % of Al, 0.3 mass % or less of N, 5.5 to 10 mass % of Mn, 0.15 to 5 mass % of Si, 0.45 mass % or less of Nb, 0.2 mass % or less of P, 0.15 mass % or less of S, and 0.15 mass % or less of Se; and the balance of Fe and inevitable impurities, the Cr included steel powder (P) is a Cr included steel powder containing: 7.5 to 25 mass % of Cr; 0.3 to 3.0 mass % of Mo; 0.25 to 2.4 mass % of C; at least one of 0.2 to 2.2 mass % of V and 1.0 to 5.0 mass % of W; and the balance of Fe and inevitable impurities, and the Cr included steel powder (Q) is a Cr included steel powder containing: 4 to 6 mass % of Cr; 4 to 8 mass % of Mo; 0.5 to 3 mass % of V; 4 to 8 mass % of W; 0.6 to 1.2 mass % of C; and the balance of Fe and inevitable impurities.

12. A production method for a sintered valve seat according to claim 7, wherein the raw powder contains 2 mass % or less of at least one selected from the group consisting of manganese sulfide powder, calcium fluoride powder, boron nitride powder, magnesium silicate mineral powder, bismuth powder, and bismuth oxide powder.

13. A production method for a sintered valve seat according to claim 7, wherein the production method further comprises:

impregnating or infiltrating a material into pores of the sintered compact after the sintering, the material selected from the group consisting of lead, lead alloy, copper, copper alloy, and aclylic resin.

* * * * *